US005383774A

United States Patent [19]

Toyama et al.

[11] Patent Number: 5,383,774

[45] Date of Patent: Jan. 24, 1995

[54] ROTARY COMPRESSOR HAVING BLADE INTEGRATED IN ROLLER

[75] Inventors: Toshiyuki Toyama; Yasushi Yamamoto; Takahiro Uematsu; Masanori Masuda, all of Osaka, Japan

[73] Assignee: Daikin Industries, Ltd., Osaka, Japan

[21] Appl. No.: 30,067

[22] PCT Filed: Feb. 2, 1993

[86] PCT No.: PCT/JP92/00122

§ 371 Date: Oct. 15, 1993

§ 102(e) Date: Oct. 15, 1993

[30] Foreign Application Priority Data

Apr. 28, 1992 [JP] Japan ..... 4-109939
Sep. 22, 1992 [JP] Japan ..... 4-252750

[51] Int. Cl.[6] ..... F04C 2/00
[52] U.S. Cl. ..... 418/66
[58] Field of Search ..... 418/54, 63, 66

[56] References Cited

U.S. PATENT DOCUMENTS

| | | | |
|---|---|---|---|
| 993,530 | 5/1911 | Kinney | 418/66 |
| 1,923,291 | 8/1933 | Zimmerer | 418/66 |
| 3,070,078 | 12/1962 | Dillenberg | 418/63 |
| 3,269,646 | 8/1965 | August | 418/66 |
| 3,521,981 | 7/1970 | Krzyszczuk | 418/63 |
| 4,836,759 | 6/1989 | Lloyd . | |

FOREIGN PATENT DOCUMENTS

| | | |
|---|---|---|
| 48-113011 | 12/1973 | Japan . |
| 61-114082 | 7/1986 | Japan . |
| 63-167095 | 7/1988 | Japan . |
| 3-70890 | 3/1991 | Japan . |

*Primary Examiner*—Richard A. Bertsch
*Assistant Examiner*—Charles G. Freary

[57] ABSTRACT

A blade (8) partitioning a cylinder chamber (41) within a cylinder (4) into a compression chamber (X) and a suction chamber (Y) is integrated with a roller (7) so as to protrude radially outwardly of the roller (7). A circular support member (11) having a receiving recess (11*a*) for receiving the tip of the blade (8) is rotatably provided on the cylinder (4). The roller (7) is rotated with respect to an eccentric shaft portion of a driving shaft (22) to which the roller (7) is fitted and normally fed with lubricating oil. By this arrangement, relative movement between the blade (8) and the roller (7) is eliminated so that power loss due to friction which would be caused by the relative movement can be reduced. Besides, gas leak from the rear chamber of the blade (8) to the suction chamber (Y) and the compression chamber (X) can be eliminated. Also, gas leak from the compression chamber (X) to the suction chamber (Y) can be reduced. Thus, volume efficiency and indication efficiency can be increased.

23 Claims, 14 Drawing Sheets

ROTARY COMPRESSOR HAVING BLADE INTEGRATED IN ROLLER

TECHNICAL FIELD

The present invention relates to a rotary compressor primarily for use in a refrigeration system, the rotary compressor being reduced in friction loss and the like by eliminating the relative movement between blade and roller.

BACKGROUND ART

A rotary compressor conventionally available is described, for example, in Japanese Utility Model Laid-Open Publication No. 114082/1986. This conventional compressor, as illustrated in FIGS. 24 and 25, has a compression section A disposed within a sealed casing and driven by a motor. The compression section A comprises: a cylinder C having a cylinder chamber B; a roller E fitted to the eccentric shaft portion of a driving shaft D extending from the motor, so that the roller E orbits within the cylinder chamber B; and a blade H disposed at an intermediate portion between a suction port F and a discharge port G both provided in the cylinder C, the blade H being allowed to advance and retreat. The blade H is so arranged that part of the high-pressure gas discharged from the discharge port G acts on the rear side of the blade H as a back pressure to thereby bring the tip of the blade H normally in contact with part of the outer circumferential surface of the roller E, by which the cylinder chamber B is divided into a compression chamber X and a suction chamber Y. Further, the discharge port G is equipped with a plate-like discharge valve I that comes into contact with or disengages apart from the face of a valve seat formed around the exit of the discharge port G to thereby open or close the discharge port G.

With the above arrangement, while the roller E is being revolved within the cylinder chamber B with rotation of the driving shaft D, the gas in the compression chamber X within the cylinder chamber B defined by the blade H is compressed. When this compression process is completed to move to the discharge process, the compressed high-pressure gas is discharged from the discharge port G into the casing by an opening action of the discharge valve I. Then, when the discharge process is completed to move to the suction process, the discharge valve I is closed to thereby close the discharge port G, so that the low-pressure gas is sucked from the suction port F into the suction chamber Y within the cylinder chamber B defined by the blade H. In this way the compression and discharge processes are repeated.

However, with the above-described arrangement that the blade H is held to the cylinder C so as to be allowed to advance and retreat and is subject to a back pressure so that the tip of the blade H is brought into contact with the outer circumferential surface of the roller E, thus bringing the blade H and the roller E into relative movement therebetween, there Would arise a need of urging the tip of the blade H against the outer circumferential surface of the roller E by making a back pressure act on the blade H so that the tip of the blade H is in contact with the circumferential surface of the roller E. Moreover, the contact between the blade H and the outer circumferential surface of the roller E, which is a metal-to-metal contact without any intervening oil, would involve a great friction loss due to the sliding contact between the blade H and the outer circumferential surface of the roller E as well as a great power loss. What is more, because of the arrangement that a back pressure developed by the high-pressure gas discharged from the discharge port G is applied to the rear side of the blade H to bring the tip of the blade H into contact with the outer circumferential surface of the roller E, the high-pressure gas in the rear chamber of the blade H would leak into the suction chamber Y between a side face of the blade H and the blade's sliding recess, as indicated by an arrow a in FIG. 24, unfavorably resulting in a deteriorated volume efficiency. Also, since the compression chamber X varies from low to high pressure, an internal pressure in the compression chamber X lower than the back pressure would cause the high-pressure gas acting on the rear-side chamber to leak into the compression chamber X between a side face of the blade H and the blade's sliding recess, disadvantageously resulting in a lowered indication efficiency. Furthermore, there would be a possibility that the high-pressure gas compressed in the compression chamber X might leak into the suction chamber Y through the contact portion between the tip of the blade H and the roller E, as indicated by an arrow b in FIG. 24, which would add to the gas leak from the side faces of the blade H, resulting in a further lowered volume efficiency.

SUMMARY OF THE INVENTION

The present invention has been developed with a view to substantially solving the above described disadvantages and has for its essential object to reduce friction loss and power loss by eliminating the relative movement between a blade and a roller and yet also to improve volume efficiency and indication efficiency by minimizing gas leak from a rear chamber or compression chamber to a suction chamber.

In order to achieve the aforementioned object, the present invention provides a rotary compressor equipped with a cylinder having a cylinder chamber, a roller fitted in the cylinder chamber and revolving within the cylinder chamber, and a blade partitioning the cylinder chamber into a compression chamber and a suction chamber, the rotary compressor being such that gas sucked through a suction port that opens to the suction chamber is compressed and discharged through a discharge port that opens to the compression chamber, wherein the eccentric shaft portion of a driving shaft to be fed with lubricating oil is fitted to the roller relatively revolvably, the blade is integrated with the roller in such a way that the blade protrudes radially outwardly of the roller and the cylinder is equipped with a support member of approximately circular shape, the support member being rotatable and having a receiving portion for receiving the tip of the blade in such a manner that the tip portion of the blade is allowed to both advance and retreat.

In the rotary compressor with the above-described arrangement, the eccentric shaft portion of the driving shaft which is fed with lubricating oil is arranged to revolve relative to the roller, which has replaced the relative movement between blade and roller involved in the prior art. As a result, compared with the prior art in which the blade and the roller are arranged to move relative to each other, the friction loss and power loss involved can be reduced. More specifically, the eccentric shaft portion of the driving shaft to which the roller is fitted is normally fed with lubricating oil through an oil feed path of the driving shaft, hence providing fluid contact therebetween, so that the frictional resistance involved in the relative revolution between the roller and the eccentric shaft portion can be reduced. Also, by making a back pressure act on the blade, the friction loss involved can be reduced as compared with the case where the blade and the roller move relative to each other, thus allowing the power loss involved to be reduced. Moreover, since the blade and the roller are integrated together, eliminating the need of applying the back pressure to the blade, the possibility of gas leak from the rear chamber of the blade into the suction chamber and the compression chamber can be obviated, with increased volume efficiency and indication efficiency. Yet also by virtue of the integration of the blade and the roller, there is no possibility of gas leak from the compression chamber into the suction chamber between blade and roller, which would occur in the prior art, thus allowing the volume efficiency to be further increased in combination with the advantage of elimination of gas leak from the rear chamber.

Preferably, the rotatable circular support member is divided into two semicircular members, and the blade is slidably disposed on the plane portions of these semicircular members while the tip of the blade is positioned radially outward of the roller with respect to the revolution center of the support member.

In this case, the support member consists of two semicircular members, of which the one semicircular member on the compression chamber side is pressurized from the side facing the compression chamber to be urged toward the radially outer portion of the roller out of the wall surface of a cylindrical hole that accommodates the semicircular member. As a result, the semicircular member on the compression chamber side is urged toward the blade as a wedge by a cam effect of the wall surface of the cylindrical hole, so that the sealing characteristic between the plane portion of the semicircular member and the blade is improved. The semicircular member on the suction chamber side is also urged toward the cylindrical wall surface of the hole, which accommodates the semicircular member, via the blade by a wedge effect of the semicircular member on the compression chamber side, so that the sealing characteristic between the semicircular member on the suction chamber side, the blade, and the cylinder wall surface is also improved. Accordingly, the compressed gas is prevented from leaking, with increased volume efficiency. Moreover, since the tip of the blade is normally positioned radially outward of the roller with respect to the revolution center of the support member, the area of contact between the blade and the plane portion of the semicircular members is increased, that is, the sealing length is increased, so that the sealing characteristic is improved. Accordingly, this also contributes to preventing the compressed gas from leaking, with increased volume efficiency.

Further, since the aforementioned support member consists of two semicircular members completely separated from each other, the work of inserting the blade into the receiving portion at the center of the support member is simplified, improving its assemblability.

Also, preferably, the roller has a fitting recess formed therein for allowing part of the base end of the blade to be inserted thereinto, and the part of the base end of the blade is fitted into the fitting recess and integrally coupled together by brazing.

In this case, since the blade is fitted to the fitting recess of the roller and integrally coupled together by brazing, the coupling between roller and blade is strengthened and simplified in implementation.

Also, desirably, on the outer circumference of the roller there are provided a stepped recess having a deeper portion at its axial center and shallower portions at both its axial ends, and fitting holes penetrating from both end faces of the stepped recess deeper portion axially outwardly, while at the base end of the blade there is provided a fitting portion having a fitting protrusion that fits to the deeper portion of the stepped recess with fitting holes provided to the fitting protrusion, the fitting portion of the blade being fitted to the stepped recess, and the fitting holes having one pin fitted therein, whereby the blade and the roller are integrated together.

In this case, the blade and the roller can be integrally coupled strongly and simply.

Also, desirably, a protrusion is provided at part of the outer circumference of the roller while a recess into which the protrusions can plunge is provided for the blade, the protrusions being fitted in the recess, and the protrusions and the blade both having a pin penetrating therethrough, whereby the blade and the roller are integrated together.

In this case, the blade and the roller can be strongly and simply integrally coupled.

Yet also, desirably, a protrusion protruding toward the discharge port and being plungeable thereinto is provided at a position opposed to the discharge port at the outer circumference of the roller.

In this case, since the protrusion is provided at a portion opposed to the discharge port at the outer circumference of the roller so as to protrude toward the discharge port and be plungeable thereinto, the protrusion provided for the roller gradually plunges into the discharge port from a position distant from the discharge port when the compression process moves to the discharge process. Besides, for this plunging, the protrusion can be made to plunge in such a manner that compressed gas within the discharge port is pushed away outside. Accordingly, the top clearance can be reduced such that when low-pressure gas is sucked into the suction chamber with the discharge process completed and succeeded by the suction process, the counterflow rate of high-pressure gas remaining within the discharge port toward the suction chamber can be reduced. As a result of this, compression loss and overheating and pulsation of sucked gas within the suction chamber can be prevented. Besides, when the discharge process starts, that is, in the earlier period during which the discharge rate increases, the protrusion has not yet plunged into the discharge port, the discharge path for gas can be ensured to a substantial extent so that the discharge resistance of gas can be reduced and overcompression of gas can be prevented, thus eliminating power loss due to this overcompression.

Further, desirably, the thickness of the roller is so set as to be thinner at the higher-temperature side wall that is in contact with the compression chamber and thicker at the lower-temperature side wall that is in contact with the suction chamber.

In this case, since the axial thickness of the roller is so set as to be thinner at the higher-temperature side wall that is in contact with the compression chamber and thicker at the lower-temperature side wall that is in contact with the suction chamber, there can be solved the disadvantage that is caused by a difference in thermal expansion quantity in the roller's thickness direction due to a difference in temperature that occurs along the circumference of the roller during operation, the roller being of non-rotation type.

More specifically, in the conventional blade reciprocating type as shown in FIG. 24, the roller itself will rotate with rotation of the driving shaft, such that the outer face of the roller makes contact alternately with the low-pressure suction chamber and the high-temperature compression chamber, resulting in an approximately equal temperature uniform along its circumference. In contrast, when the roller is of the non-rotation type, the portion of the roller that makes contact with the low-temperature suction chamber and the high-temperature compression chamber is fixedly determined on its circumference, so that if the protruding portion of the blade is on the upper side and rotation angle is taken in the clockwise direction with the basic point at 0 degrees, the temperature of the roller wall will result in a high-temperature peak in the vicinity of 270 degrees and a low-temperature minimum in the vicinity of 90 degrees. For this reason, the high-temperature side wall that makes contact with the compression chamber is subject to a greater thermal expansion with a peak in the vicinity of 270 degrees while the low-temperature side wall that makes contact with the suction chamber is subject to a smaller thermal expansion with the minimum in the vicinity of 90 degrees. The difference between these thermal expansions may cause a difference in the thickness of the roller in the order of several tens of microns. On the other hand, the cylinder is located within the casing to be filled with high-pressure discharged gas, so that its thermal expansion can be assumed to be approximately uniform along the circumference of the cylinder chamber. Also, the thickness of the cylinder is set taking into account the maximum thermal expansion amount, with the result that a large clearance is formed between the inner surface of the cylinder and the end face of the low-temperature side wall of roller being in contact with the suction chamber and smaller in the amount of thermal expansion. This is disadvantageous because the volume efficiency would lower due to gas leak and the heating of sucked gas would result. Thus, by arranging the thickness of the roller to be thinner at its high-temperature side that makes contact with the compression chamber and thicker at its low-temperature side that makes contact with the suction chamber, the difference in thermal expansion can be put into good use during operation such that the high-temperature side and low-temperature side wall are equalized in thickness, thereby dissolving the possibility of gas leak due to imbalance in the thickness of the roller.

Further, desirably, in the rotary compressor, the blade is integrated with the roller so as to protrude radially outwardly of the roller, and besides the length of the blade and the radius of the support member are set in such a relation therebetween that the tip of the blade will not go beyond the rotation center of the support member when the tip of the blade has reached the deepest portion of the receiving portion.

In this case, with the roller and the blade displaced toward the compression chamber, the blade and the receiving portion urge against each other by the edge on the suction chamber side of the tip of the blade and the entrance edge of the receiving portion on the compression chamber side, such that both edges serve to seal. Therefore, the space between the compression chamber and the suction chamber can be sealed satisfactorily. Furthermore, since the tip of the blade will not go beyond the rotation center of the support member as the compression process progresses such that the roller and the blade are displaced toward the suction chamber side, the blade and the receiving .portion urge against each other by the edge of the tip of the blade on the suction chamber side and the entrance edge of the receiving portion on the compression chamber side, so that the blade and the receiving portion are sealed by both edges. Therefore, the space between the compression chamber and the suction chamber can be sealed satisfactorily.

Further, desirably, in the rotary compressor, the blade is integrated with the roller so as to protrude radially outwardly of the roller, and besides at the center of the support member there is provided a hole which communicates with the receiving portion and which has such a large thickness that the contact end portion between the tip of the blade and the receiving portion is prevented from going beyond the rotation center of the support member when the tip of the blade reaches the deepest portion of the receiving portion.

In this case, by providing the hole, the contact end portion at which the tip of the blade and the receiving portion make contact with each other will never go beyond the rotation center of the support member. Accordingly, when the roller and the blade are displaced toward the compression chamber, the blade and the receiving portion urge against each other by the contact end portion of the tip of the blade and the entrance edge of the receiving portion on the compression chamber side, so that both edges serve to seal. As a result, the space between the compression chamber and the suction chamber can be sealed satisfactorily. Besides, as the compression process progresses such that the roller and the blade are displaced toward the suction chamber, the tip of the contact end portion of the blade will never go beyond the rotation center of the support member. Therefore, the blade and the receiving portion urge against each other by the contact end portion of the blade and the entrance edge of the receiving portion on the compression chamber side, so that both edges serve to seal. As a result, the space between the compression chamber and the suction chamber can be sealed satisfactorily. Also, since the tip of the blade and the contact end portion of the receiving portion are so arranged as not to go beyond the rotation center of the support member by means of the hole, there is no need of enlarging the radius of the support member so that the structure around the support member can be compacted.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

The embodiments of the present invention are now described in detail with reference to the drawings.

(The first embodiment)

Figure 10:
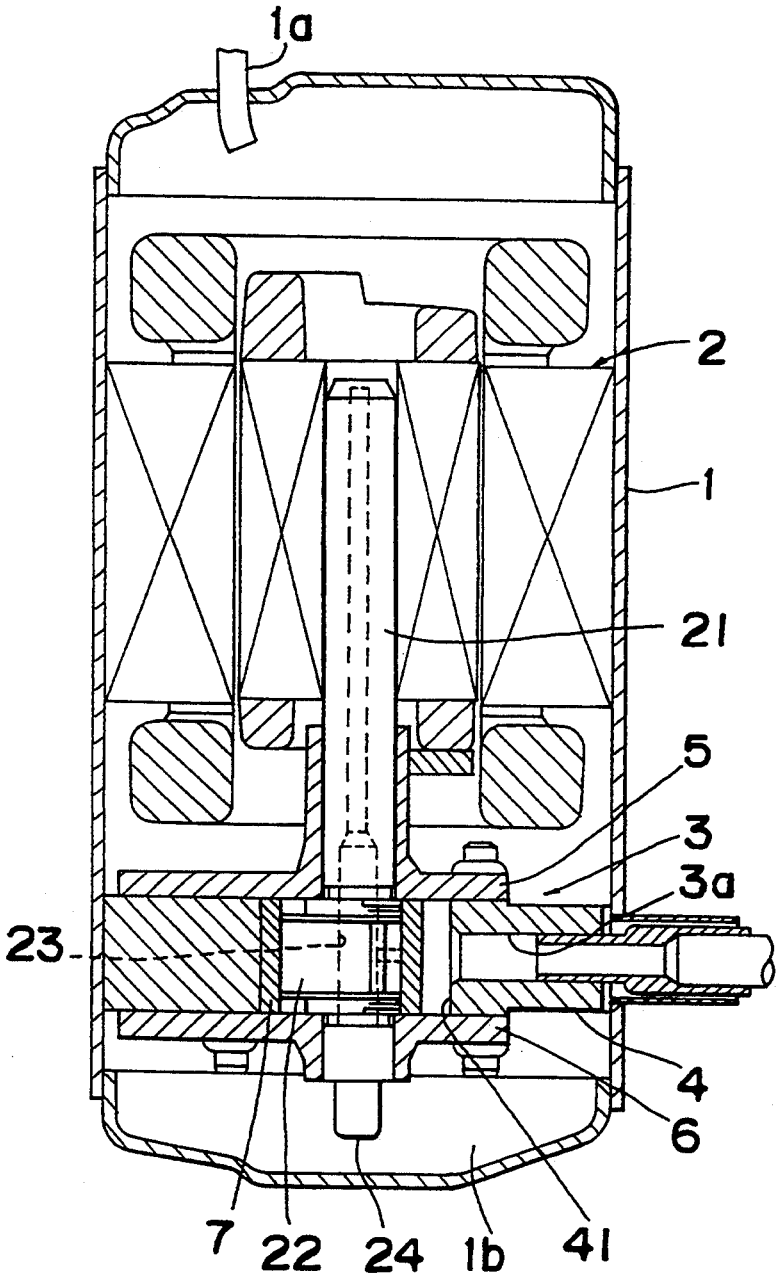
FIG. 10 is a longitudinal sectional view showing the overall construction of the rotary compressor.

The rotary compressor as shown in FIG. 10 has a motor 2 disposed at an inner upper portion of a sealed casing 1, and a compression section 3 disposed below the motor 2, the compression section 3 being driven by a driving shaft 21 extending from the motor 2. The compression section 3 comprises a cylinder 4 having a cylinder chamber 41 inside thereof; a front head 5 and a rear head 6 provided at upper and lower open portions of the cylinder 4 so as to be opposed to each other; and a roller 7 provided within the cylinder chamber 41 so as to be revolvable, wherein the lower side portion of the driving shaft 21 is held by bearings respectively provided to the heads 5, 6, and the roller 7 is rotatably fitted to an eccentric shaft portion 22 of the driving shaft 21, so that the roller 7 revolves in sliding contact with the eccentric shaft portion 22 as the driving shaft 21 rotates. Further, an oil feed path 23 is provided at the center of the driving shaft 21 so as to open to a bottom oil sump **1*b* of the casing 1. A pump 24 is connected to the entrance of the oil feed path 23. An intermediate outlet of the oil feed path 23 is opened to the sliding face of the eccentric shaft portion 22 facing the roller 7. Lubricating oil pumped up from the oil sump 1*b* by the pump 24 is fed to the sliding face through the oil feed path 23. In addition, reference numeral 1*a* represents an external discharge tube connected to the upper side of the casing 1**.

Figure 1:
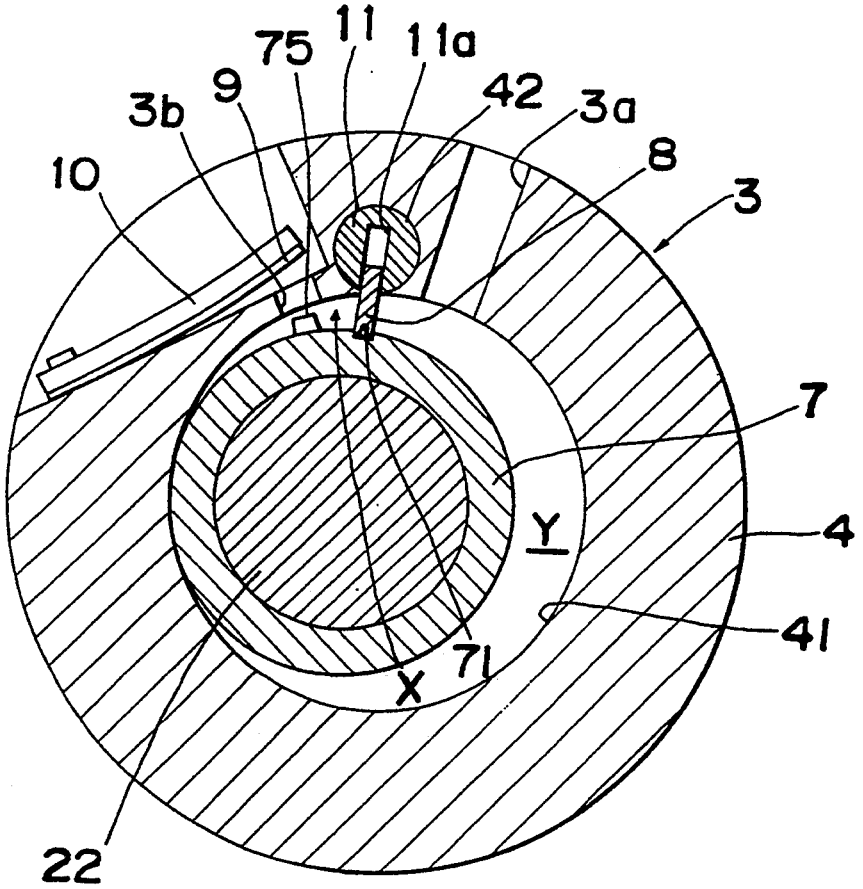
FIG. 1 is a sectional view showing the main part of the cylinder of the first embodiment of the rotary compressor according to the present invention.

In the compression section 3, as shown in FIG. 1, a sucked gas suction port **3*a* that opens to the cylinder chamber 41 is formed in the cylinder 4, and a compressed gas discharge port 3*b* that opens to the cylinder chamber 41 is formed in the cylinder 4 in proximity to the suction port 3*a*. At an intermediate portion between these suction port 3*a* and discharge port 3*b*, a blade 8 partitioning the interior of the cylinder chamber 41 into a compression chamber X and a suction chamber Y is integrated with the roller 7. At the discharge port 3*b* a plate-like discharge valve 9 is disposed that makes contact with or disengages from a valve seat face formed around the exit of the discharge port 3*b* to thereby open or close the discharge port 3*b*. In addition, reference numeral 10 represents the holding plate of the discharge valve 9**.

In the rotary compressor having the above-described arrangement, the blade 8 is provided integrally an part of the outer periphery of the roller 7 so as to protrude radially outwardly of the roller 7, as illustrated in FIG. 1, and a cylindrical retaining hole 42 is provided between the suction port **3*a* and the discharge port 3*b* in the cylinder 4. At the retaining hole 42, a cylindrical support member 11 having a receiving recess 11*a* whose one end is opened to the cylinder chamber 41 side is rotatably held, into which receiving recess 11*a* of the support member 11 the protruding tip of the blade 8 is slidably inserted. It is noted that the retaining hole 42 and the support member 11** may also be of spherical surface or spherical body.

Figure 2:
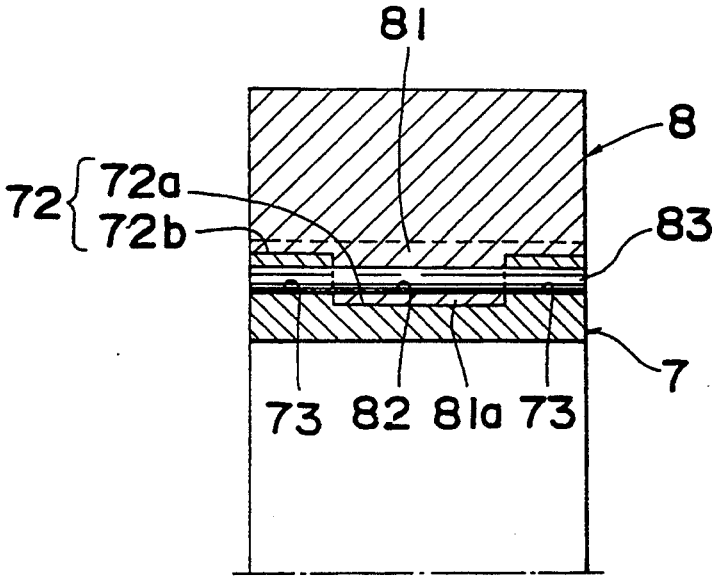
FIG. 2 is a sectional view showing an example of the mounting structure of a blade.
Figure 3:
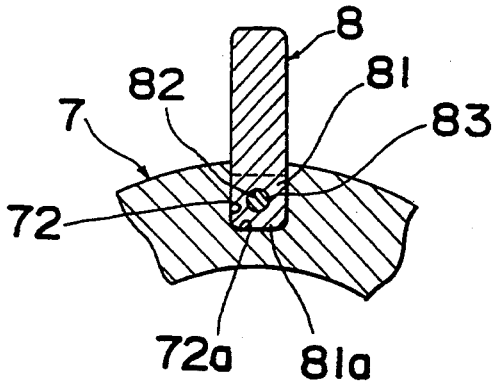
FIG. 3 is a longitudinal sectional view at the center of FIG. 2.
Figure 4:
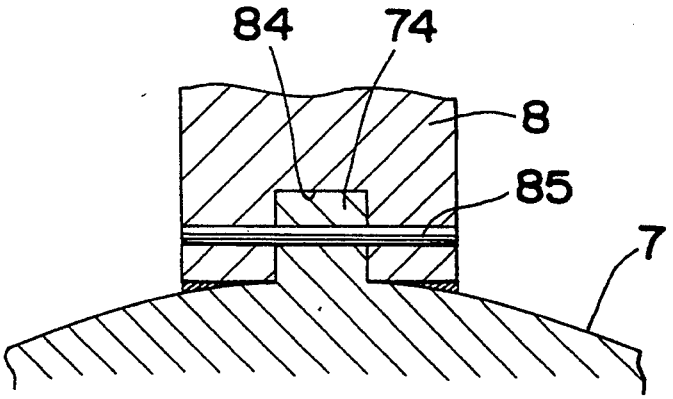
FIG. 4 is a sectional view showing another mounting example of a blade.

For the blade 8 on be provided to part of the outer periphery of the roller 7, for example as shown in FIG. 1, a fitting recess 71 is formed on the roller 7 side so as to allow part of the base end of the blade 8 to be inserted thereinto, and part of the base end of the blade 8 is inserted into the fitting recess 71 and as such integrated therewith by brazing or the like. Otherwise, as shown in FIGS. 2 and 3, the outer periphery of the roller 7 are provided with a stepped recess 72 having a deep recess 72*a* at its axial center and a shallow recess 72*b* at both ends, and a fitting hole 73 that penetrates axially outwardly from both end faces of the deep-recess portion of the stepped recess 72. Furthermore, to the base end of the blade 8 is provided with a fitting portion 81 having a fitting protrusion 81*a* that fits into the deep-recess portion of the stepped recess 72, and a fitting hole 82 is provided in the fitting protrusion 81*a*. The fitting portion 81 of the blade 8 is fitted to the stepped recess 72 and a pin 83 is fitted into the fitting holes 73 and 82, thereby fixing the blade 8 to the roller 7. In this case, it is preferable that an adhesive is applied to the fitting portion of the fitting portion 81 to be fitted in the stepped recess 72 as an aid. Further, the blade 8 may also be fixed to the roller 7 in the following way. As illustrated in FIG. 4, a convex portion 74 is provided on part of the periphery of the roller 7 and a recess 84 engageable into the convex portion 74 is provided on the blade 8. With the convex portion 74 engaged with the recess 84, a pin 85 is penetrated through the convex portion 74 and the blade 8 and also, adhesive is applied between opposing faces of the blade 8 and the roller 7, thereby fixing the blade 8 to the roller 7.

In this arrangement, as the driving shaft 21 operates, the tip of the blade 8 provided on the roller 7 is made to get in and out of the receiving recess 11*a* of the support member 11. Besides, as the support member 11 rotates, the blade 8 is made to swingingly advance and retreat in the radial direction. By this arrangement, the interior of the cylinder chamber 41 is partitioned into the compression chamber X and the suction chamber Y. By so doing, the roller 7 is put into relative revolution with respect to the eccentric shaft 22, in which case there is involved no relative movement between the blade 8 and the roller 7 and therefore the tip of the blade 8 does not slide on the outer circumferential face of the roller 7, other than in the prior art. As a result, abrasion due to friction between the blade 8 and the roller 7 and power loss due to the friction can be eliminated. Therefore, although the blade 8 and the roller 7 do not take the relative movement, instead the roller 7 and the eccentric shaft 22 take a relative revolution. However, the eccentric shaft 22 of the driving shaft 21 to which the roller 7 fits is normally fed with lubricating oil through the oil feed path 23 of the driving shaft 21, making fluid contact between the blade 8 and the roller 7 such that frictional resistance can be reduced. Compared with the prior art in which, with back pressure applied to act on the blade 8, the blade 8, being in contact with the roller 7, is made to follow relative movement, friction loss as well as power loss involved in this case also can be reduced.

Further, since the blade 8 is provided integrally with the roller 7, there is no need of applying the back pressure to act on the blade 8. Therefore, there will no gas leak from the rear chamber of the blade into the suction chamber Y or the compression chamber X, which would occur in the prior art, thus increasing volume efficiency and indication efficiency. In addition, gas leak from the compression chamber X to the suction chamber Y is also reduced such that the volume efficiency Can be further increased. In more detail, the gas fluid within the compression chamber X may leak from between both side wall faces of the blade 8 and the receiving recess 11*a* of the support member 11 toward the suction chamber Y. However, since the gas within the compression chamber X varies from low to high pressure, gas leak will not be incurred until the pressure difference between the gas fluid pressure within the compression chamber X and that within the suction chamber Y is raised above a specified pressure, and otherwise gas leak will not occur. Accordingly, the amount of gas leak from the compression chamber X to the suction chamber Y can be reduced substantially, compared with the prior art.

Further, an approximately cylindrical protrusion 75 smaller in diameter than the discharge port 3*b* is provided at a portion on the circumference of the roller where the discharge port 3*b* is opposed thereto, so that at the time of starting the discharge process the protrusion 75 is located where it does not plunge into the discharge port 3*b*, and the protrusion 75 gradually plunges into the discharge port 3*b* as the discharge amount decreases with progress of the discharge process. The compressed gas within the discharge port 3*b* is pushed outside by this plunging.

Figure 5:
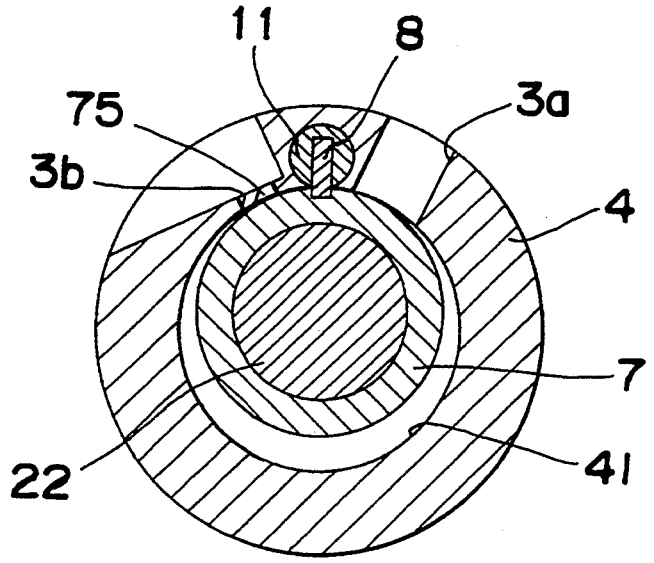
FIG. 5 is a sectional view showing a case where the revolution angle of a roller is 0 degrees.
Figure 6:
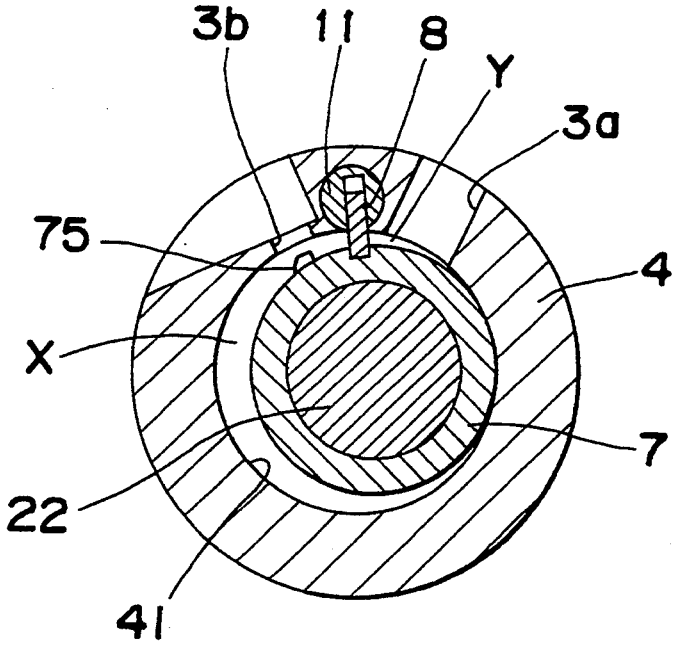
FIG. 6 is a sectional view showing a case where the revolution angle of the roller is 90 degrees.

Next, the operation of the rotary compressor with the above-described arrangement is explained. First, as shown in FIG. 5, when the suction and compression processes are started with the revolution angle of the roller 7 being 0 degrees, the blade 8 has been inserted deep inside the receiving recess 11*a* of the support member 11. In this state, the protrusion 75 provided on the roller 7 has been plunged into the discharge port 3*b*. As this state moves to another where the roller 7 revolves by 90 degrees, the protrusion 75 leaves from the discharge port 3*b* and the blade 8 swings with the support member 11 rotating. With the blade 8 slid outward of the receiving recess 11*a*, the gas fluid is compressed in the compression chamber X within the cylinder chamber 41 defined by the blade 8, as the roller 7 revolves. Simultaneously, in the suction chamber Y the gas fluid is sucked from the suction port 3*a*.

Figure 7:
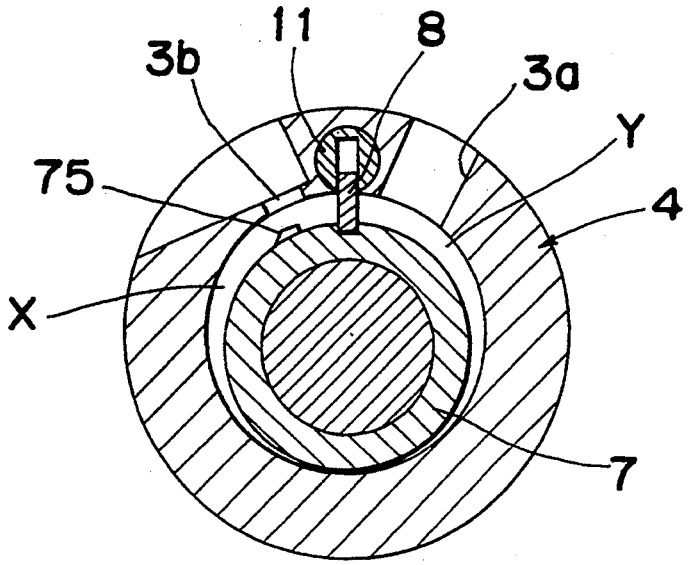
FIG. 7 is a sectional view showing a case where the revolution angle of the roller is 180 degrees.
Figure 8:
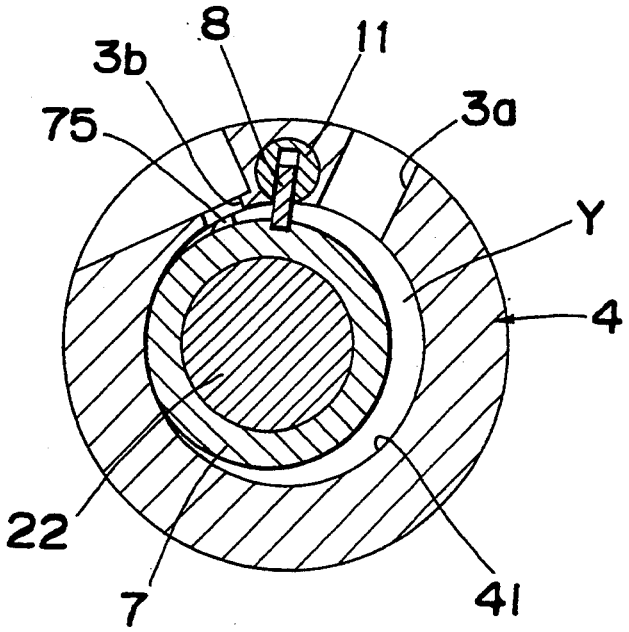
FIG. 8 is a sectional view showing a case where the revolution angle of the roller is 270 degrees.
Figure 9:
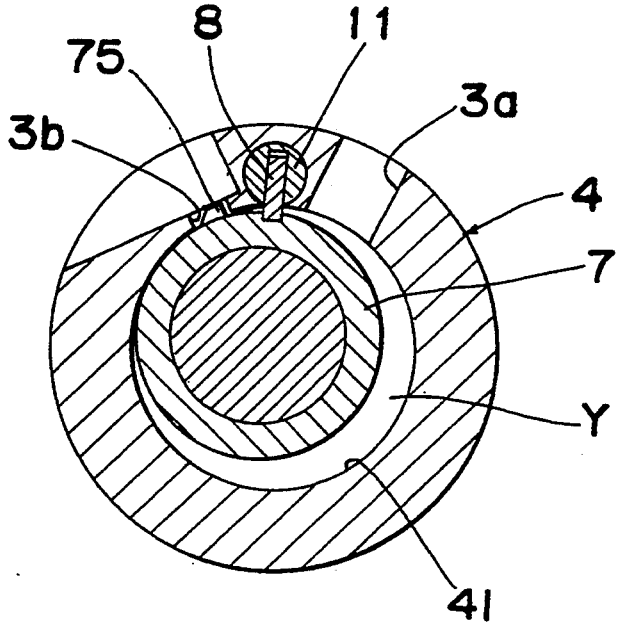
FIG. 9 is a sectional view showing a case where the revolution angle of the roller is 315 degrees.

Furthermore, as shown in FIG. 7, when the revolution angle of the roller 7 becomes 180 degrees, the gas compression in the compression chamber X and the gas suction in the suction chamber Y are continued, where the blade 8 has been withdrawn to the maximum extent from the receiving recess 11*a* of the support member 11. Also, as shown in FIG. 8, when the revolution angle of the roller 7 becomes 270 degrees reaching the discharge process, the blade 8 provided on the roller 7 gradually slides inward with progress of the revolution of the roller 7 while the gas compressed in the compression chamber X is discharged. Simultaneously, also the protrusion 75 also starts plunging into the discharge port 3*b*. Then, as shown in FIG. 9, when the roller 7 revolves from 315 to 360 degrees (FIG. 1), the gas compressed in the compression chamber X is discharged from the discharge port 3*b*, completing the discharge process. At this time, the protrusion 75 is plunged into the discharge port 3*b*, reducing the top clearance of the discharge port 3*b*. Therefore, the residual gas within the discharge port 3*b* can be suppressed to be small so that any reduction in volume efficiency due to this residual gas flowing back to the suction chamber of FIG. 5 can be suppressed.

As described above, at the time of moving to the discharge process, the protrusion 75 provided on the roller 7 is apart from the discharge port 3*b* and gradually plunges into the discharge port 3*b* in accordance to the swinging angle of the roller 7 in such a way that the compressed gas within the discharge port 3*b* is extruded outside. Accordingly, the top clearance can be reduced. Moreover, when low-pressure gas is sucked into the suction chamber Y in the suction process after completion of the discharge process, the backflow amount of the high-pressure gas remaining in the discharge port 3*b* into the suction chamber Y can be reduced. As a consequence of this, compression loss as well as overheating and pulsation of the sucked gas in the suction chamber Y can be prevented. Also, at the start of discharge process, i.e., at an initial stage where the discharge amount of gas becomes large, the protrusion 75 has not plunged into discharge port 3*b*. Therefore, the path for discharging gas can be ensured to a substantial extent, so that the gas discharge resistance can be reduced and gas can be prevented from being overcompressed, allowing elimination of power loss due to this overcompression.

Figure 11:
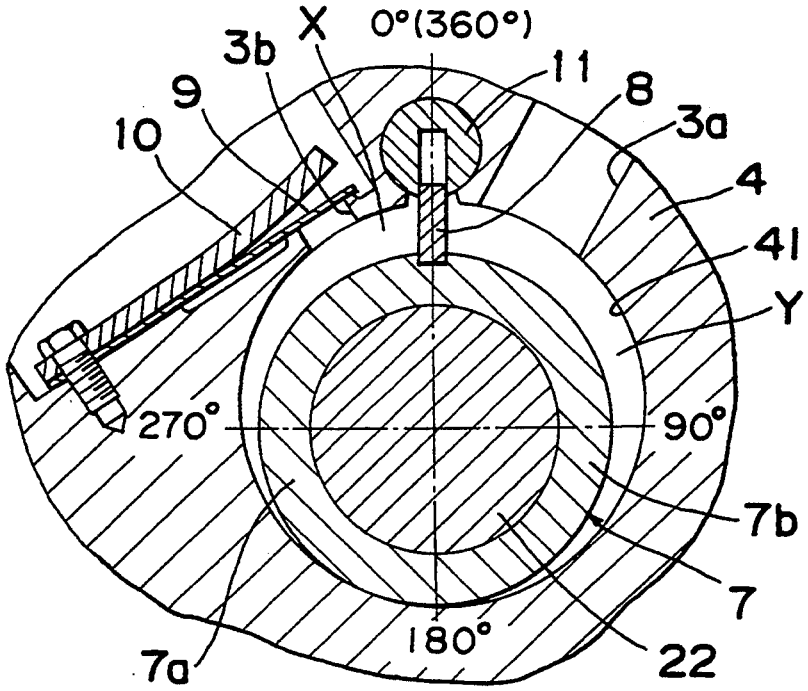
FIG. 11 is a plan sectional view showing the main part of the cylinder for explaining a modification of the first embodiment.
Figure 12:
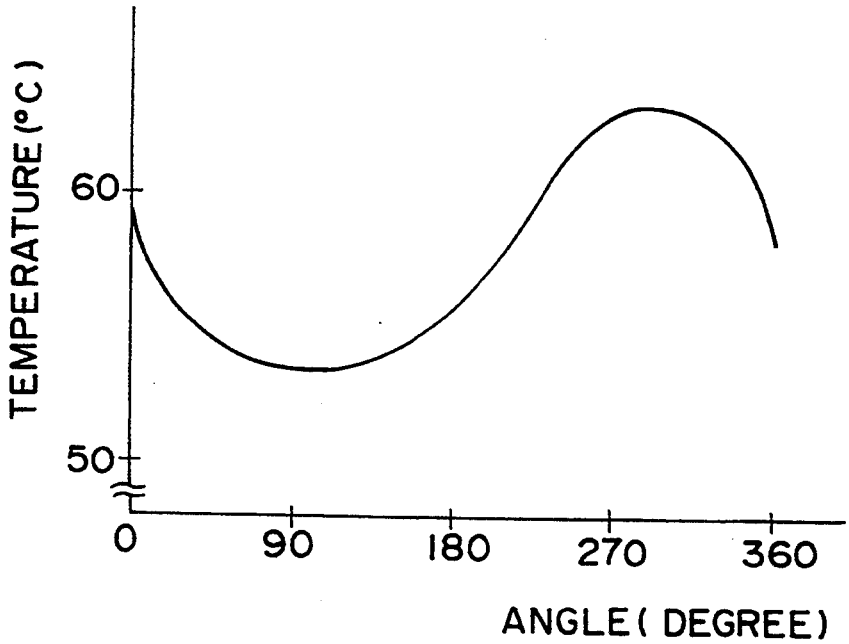
FIG. 12 is a view showing the wall temperature with respect to the angle of the roller for explaining the modification.
Figure 13:
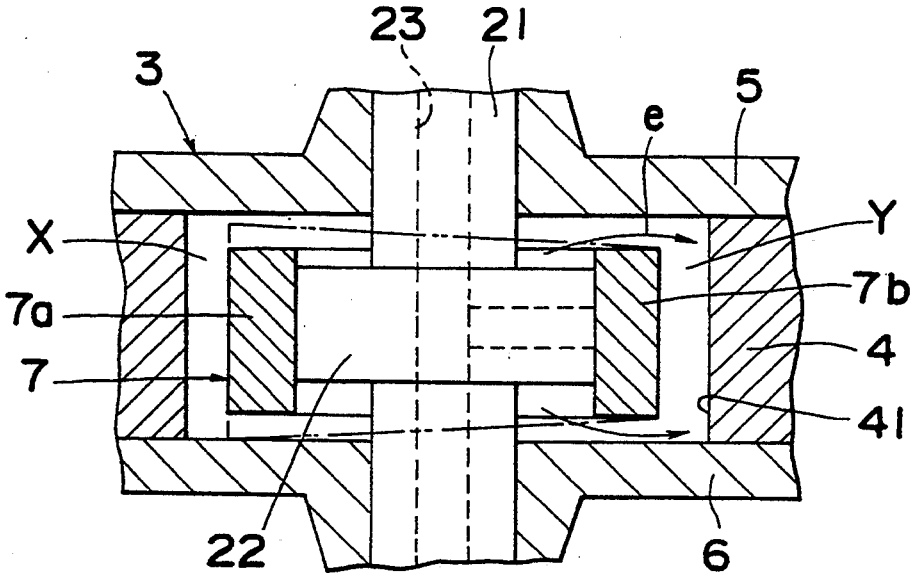
FIG. 13 is a longitudinal sectional view showing the main part of the cylinder for explaining the modification.

Incidentally, when the roller 7 is of non-rotation type, the wall portion of the roller 7 that makes contact with the low-temperature suction chamber Y and the high-temperature compression chamber X is fixedly determined on its circumference. Therefore, as shown in FIG. 11, if revolution angle is taken in the clockwise direction with the protruding portion of the blade 8 being the basic point 0 degree, the temperature of the wall portion of the roller 7 varies as shown in FIG. 12, with the result that the high-temperature peak is in the vicinity of 270 degrees and the low-temperature peak is in the vicinity of 90 degrees. For this reason, the high-temperature side wall portion 7*a* that makes contact with the compression chamber X is subject to greater thermal expansion with the vicinity of 270 degrees being the peak, and the low-temperature side wall portion 7*b* is subject to smaller thermal expansion with the vicinity of 90 degree having the minimum value. Due to the difference between these thermal expansions, the thickness of the roller 7 involves a difference in the order of several tens microns, as exaggeratedly shown by imaginary lines in FIG. 13. On the other hand, the cylinder 4, which is located within the casing to be filled with high-pressure discharged gas, can be considered as uniform in its thermal expansion along the circumference of the cylinder chamber 41. Also, since the thickness of the cylinder 4 is set by allowing for the maximum thermal expansion amount, a large clearance is caused with respect to the end face of the low-temperature side wall portion 7*b* that is in contact with the suction chamber Y and small in thermal expansion. Thus, the gas may leak as shown in arrow e in FIG. 13, which causes a disadvantage that sucked gas is heated, lowering the volume efficiency.

Figure 14:
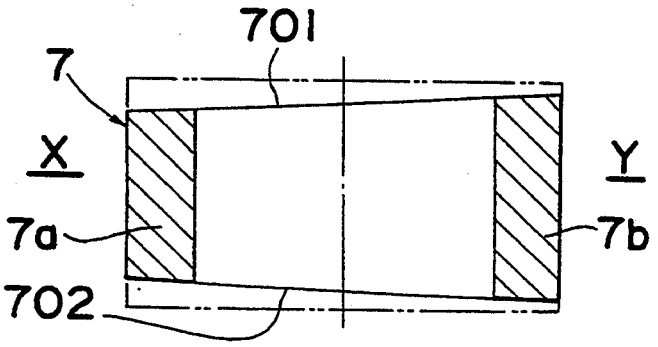
FIG. 14 is a sectional view showing an example of the practical configuration of the roller in the modification.

In view of this problem, the axial thickness of the roller 7 is, as shown in FIG. 14, so set as to be thinner at the high-temperature side wall portion 7*a* that makes contact with the compression chamber X and thicker at the low-temperature side wall portion 7*b* that makes contact with the suction chamber Y. This arrangement can be accomplished by forming the upper and lower end faces of the roller 7 with slanted faces 701 and 702 that makes the thickness thinnest in the vicinity of 270 degrees corresponding to the highest temperature and highest in the vicinity of 90 degrees corresponding to the lowest temperature, where the angle is taken in the clockwise direction with the protruding portion of the blade assigned to the basic point.

In this case, during operation, the high-temperature side wall portion 7*a* that originally has a small thickness will thermally expand to a greater extent than the low-temperature side wall portion 7*b* that originally has a great thickness. As a result, as illustrated by imaginary lines in the figure, these high-temperature side wall portion 7*a* and low-temperature side wall portion 7*b* are made uniformly equal in thickness so that the clearance on the upper and lower end faces can be held to be a uniform, small clearance along the circumference of the roller 7. Thus, the possible gas leak via the upper and lower end faces of the roller 7 can be reduced, so that heating of sucked gas can be suppressed further satisfactorily and volume efficiency can be further increased. It is noted that the roller 7 is made by using a molybdenum-nickel-chrome alloy or the like, the difference in thickness between the high-temperature side wall portion 7*a* and the low-temperature side wall portion 7*b* being set to the order of several tens of microns.

Figure 15:
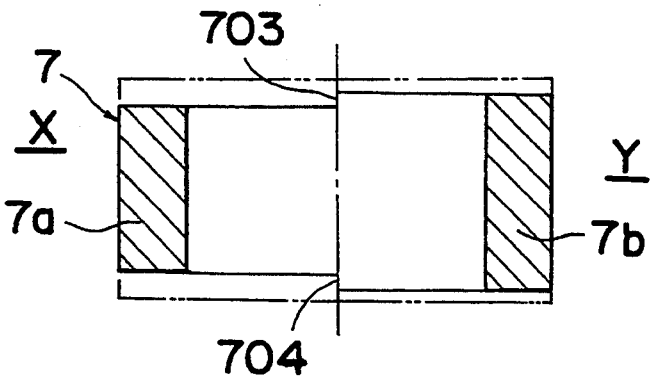
FIG. 15 is a sectional view showing a modification of the practical configuration of the roller.

The height of the roller 7, as shown in FIG. 15, may also be set so that the high-temperature side wall portion 7*a* consisting of the semicircular portion that makes contact with the compression chamber X in the angle range of 180 to 360 degrees is uniformly thin and the low-temperature side wall portion 7*b* consisting of the semicircular portion that makes contact with the suction chamber Y in the angle range of 0 to 180 degrees is uniformly thick, where its upper and lower end faces are shaped to have step gaps 703 and 704. This arrangement, although involving a slight nonuniformity of end faces at the portions of the step gaps, allows the processing to be simplified in comparison with that shown in FIG. 14, and further allows the end faces of the high-temperature side wall portion 7*a* and the low-temperature side wall portion 7*b* to be aligned during operation in comparison with that formed with a single-height cylinder. Thus, the possible gas leak via the end faces can be reduced.

As described above, in the rotary compressor of the present embodiment, the blade 8 partitioning the cylinder chamber 41 of the cylinder 4 into the compression chamber X and the suction chamber Y is integrated with the roller 7 so as to protrude radially outwardly of the roller 7. Besides, the support member 11 having the receiving recess 11*a* for receiving the protruding-side tip of the blade 8 is rotatably provided on the cylinder 4. The roller 7 and the eccentric shaft portion of the driving shaft to which the roller 7 is fitted and which is fed with lubricating oil are put into relative revolution, thereby eliminating the relative movement between blade and roller, which was found in the prior art. As a result, friction loss and power loss can be reduced, compared with the prior art involving the relative movement between blade and roller. Therefore, the eccentric shaft portion of the driving shaft to which the roller is fitted is normally fed with lubricating oil through the oil feed path of the driving shaft, resulting in a fluid contact. Thus, the resulting frictional resistance can be reduced, compared with the case of the contact between blade and roller. Accordingly, friction loss as well as power loss can be reduced, compared with the prior art in which the blade 8 is subject to a back pressure acting thereon to put the blade and the roller into relative movement. What is more, the blade 8 is integrally provided on the roller 7, eliminating the need of applying the back pressure to the blade 8. Therefore, gas leak from the rear chamber of the blade to the suction chamber Y and the compression chamber X can be eliminated, allowing the volume efficiency and indication efficiency to be increased. Further, since the blade 8 and the roller 7 are provided integrally together, gas leak from .the compression chamber X to the suction chamber Y can also be prevented, allowing the volume efficiency to be further increased with the advantage of elimination of the gas leak from the rear chamber.

At a portion of the periphery of the roller 7 where the discharge port 3*b* is opposed thereto, the protrusion 75 is provided so as to protrude toward the discharge port 3*b* and be plungeable into the discharge port 3*b*. By this arrangement, when the compression process moves to the discharge process, the protrusion 75 can be gradually plunged into the discharge port 3*b* from a position where the protrusion 75 is separate from the discharge port 3*b*. Also, at the time of this plunging, compressed gas within the discharge port 3*b* can be urged so as to be pushed away outside, so that the top clearance can be reduced. Therefore, when low-pressure gas is sucked into the suction chamber Y with the suction process entered after completion of the discharge process, the amount of backflow of the high-pressure gas remaining in the discharge port 3*b* toward the suction chamber Y can be reduced. As a consequence of this, at the start of the discharge process, i.e., in an earlier state of the discharge process involving a greater discharge amount, the protrusion 75 has not plunged into the discharge port 3*b*, ensuring a substantial path for discharging gas. Accordingly, the gas discharge resistance can be reduced and overcompression of gas can be prevented, and power loss due to this overcompression can be eliminated.

Furthermore, the height of the roller 7 is so set that the high-temperature side wall portion 7*a* that defines the compression chamber X is thinner and the low-temperature side wall portion 7*b* that defines the suction chamber Y is thicker. By this arrangement, a difference in thermal expansion due to a difference in temperature that arises along the circumference of the roller 7 during operation can be put into good use, so that the thickness of the high-temperature side wall portion 7*a* and that of the low-temperature side wall portion 7*b* can be made equal. Therefore, gas leak due to imbalance of the height of the roller can be further reduced, heating of sucked gas can be reduced satisfactorily, and the volume efficiency can be further increased.

(The second embodiment)

Figure 20:
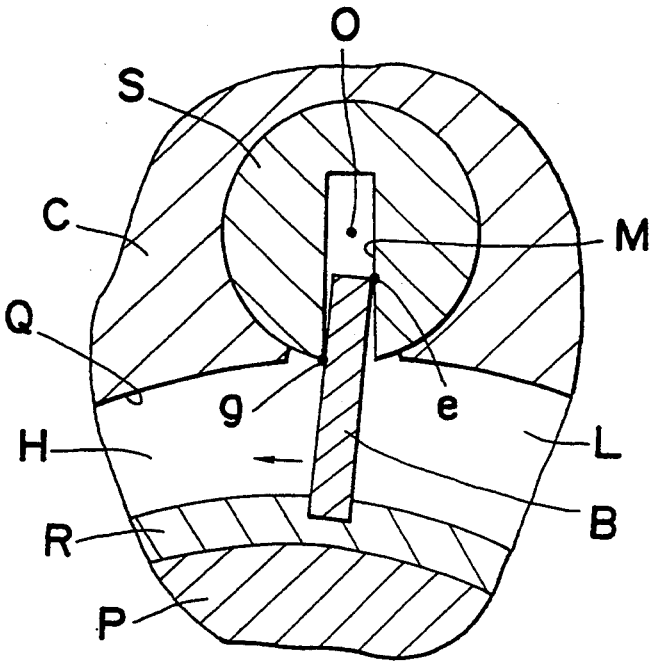
FIG. 20 is a partly sectional view for explaining a situation in the course of the compression process according to the rotary compressor of the first embodiment of the invention.
Figure 21:
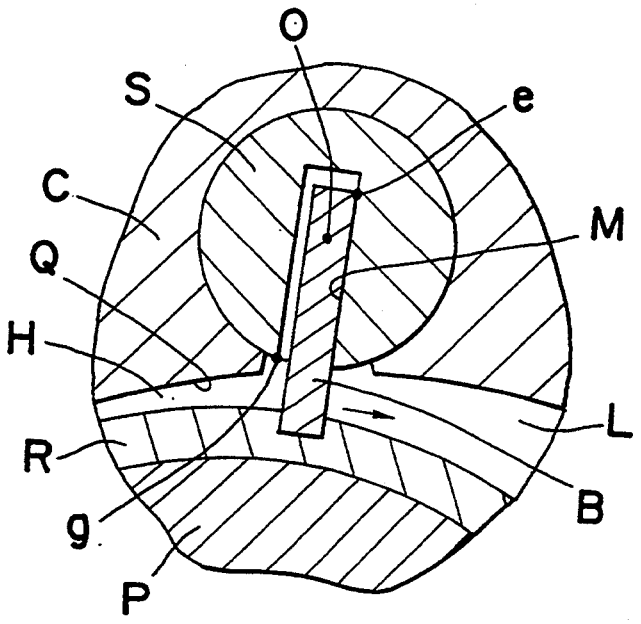
FIG. 21 is a partly sectional view showing the situation immediately before completion of the compression process of the first embodiment.

In the first embodiment, as shown in FIGS. 20 and 21, the blade B is integrally provided on the periphery of the roller R. Besides, the support member S is rotatably held at a portion radially outside of the cylinder chamber Q in the cylinder C. The support member S has a receiving recess M for receiving the protruded tip of the blade B over a relatively long span that exceeds the rotation center of the support member S. As the roller R revolves with eccentric rotation of the eccentric portion, that is, a crank pin P, the blade B advances into and retreats from the receiving recess M while the support member S swings, so that sucked gas taken into the suction chamber L is compressed in the compression chamber H. In this way, the blade B and the roller R are integrated together, eliminating the contact therebetween. Accordingly, gas leak can be reduced and the volume efficiency can be increased.

However, in the case of the first embodiment, as shown in FIG. 20, when the roller R and the blade B are displaced in the direction indicated by the left-directed arrow in the course of compression process, the blade B and the receiving recess M urge against each other via the blade right tip portion e and the recess left end portion g. By the edge contact of these end portions e and g, the compression chamber H can be sealed satisfactorily with respect to the suction chamber L. Nevertheless, as shown in FIG. 21, immediately before the compression process is completed and when the roller R and the blade B have changed in the direction of displacement to the one indicated by the right-directed arrow and further when the tip of the blade B has got beyond the rotation center O of the support member S, the recess left end portion g and the blade B separate from each other so that they no longer urge against each other. Instead, the right side face of the blade B comes into contact with the receiving recess M, causing a small clearance to open between the left side face of the blade B and the receiving recess M. Via this clearance, high-pressure gas flows in from the compression chamber H to the bottom of the receiving recess M, so that the gas leak to the suction chamber L tends to occur. Moreover, residual gas that has stood at the bottom of the receiving recess M at the end of the compression process would re-expand, thus reducing the volume efficiency unfavorably.

The object of the second embodiment is to provide a rotary compressor adapted to reduce gas leak which might occur via the peripheral part of the roller of swinging blade construction and at the same time to reduce gas leak via the clearance between blade and receiving recess which would result in re-expansion of the leaking gas, thereby capable of further improving the volume efficiency satisfactorily.

Figure 16:
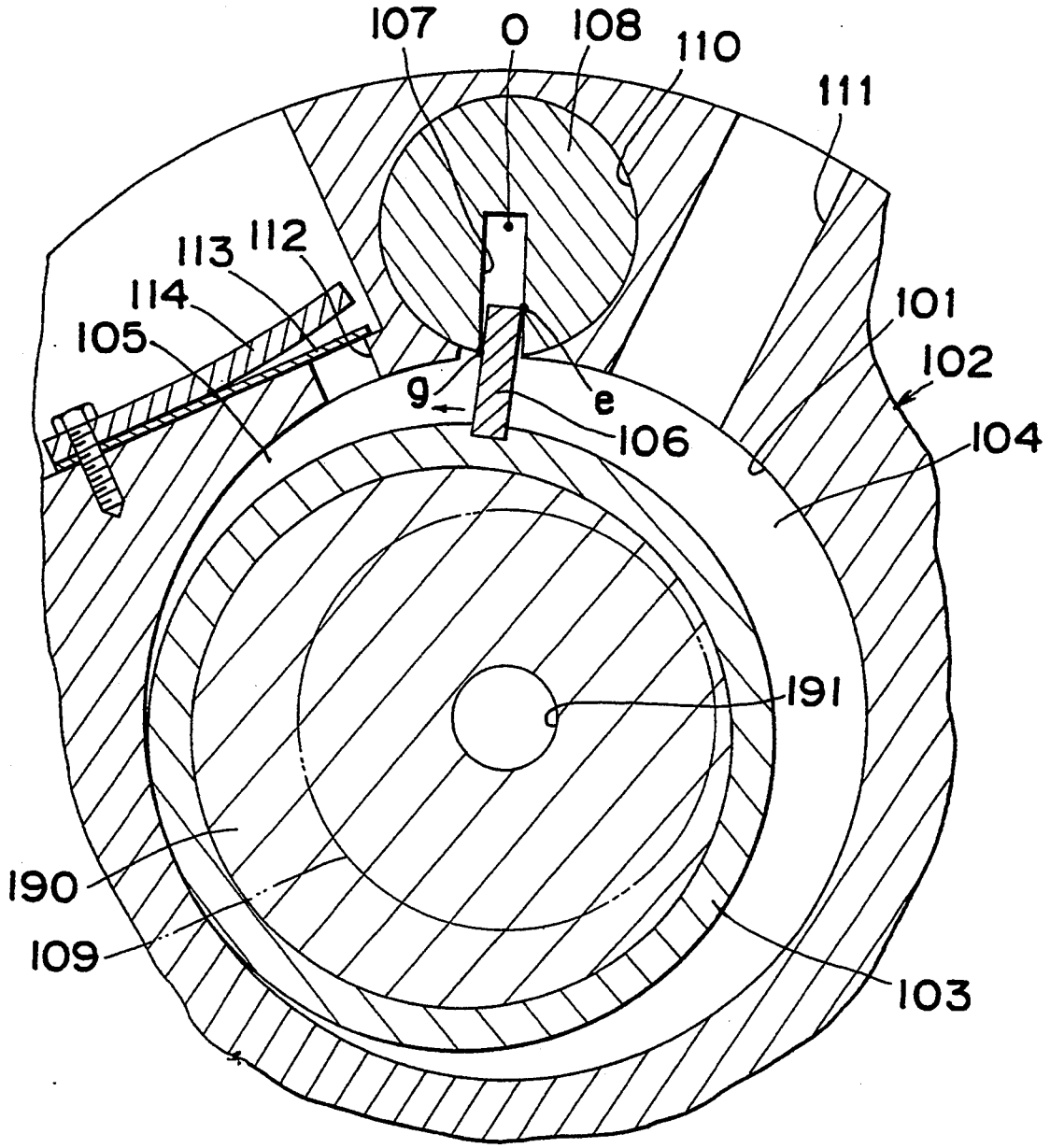
FIG. 16 is a sectional view showing the situation in the course of the compression process according to the second embodiment of the rotary compressor of the invention.
Figure 17:
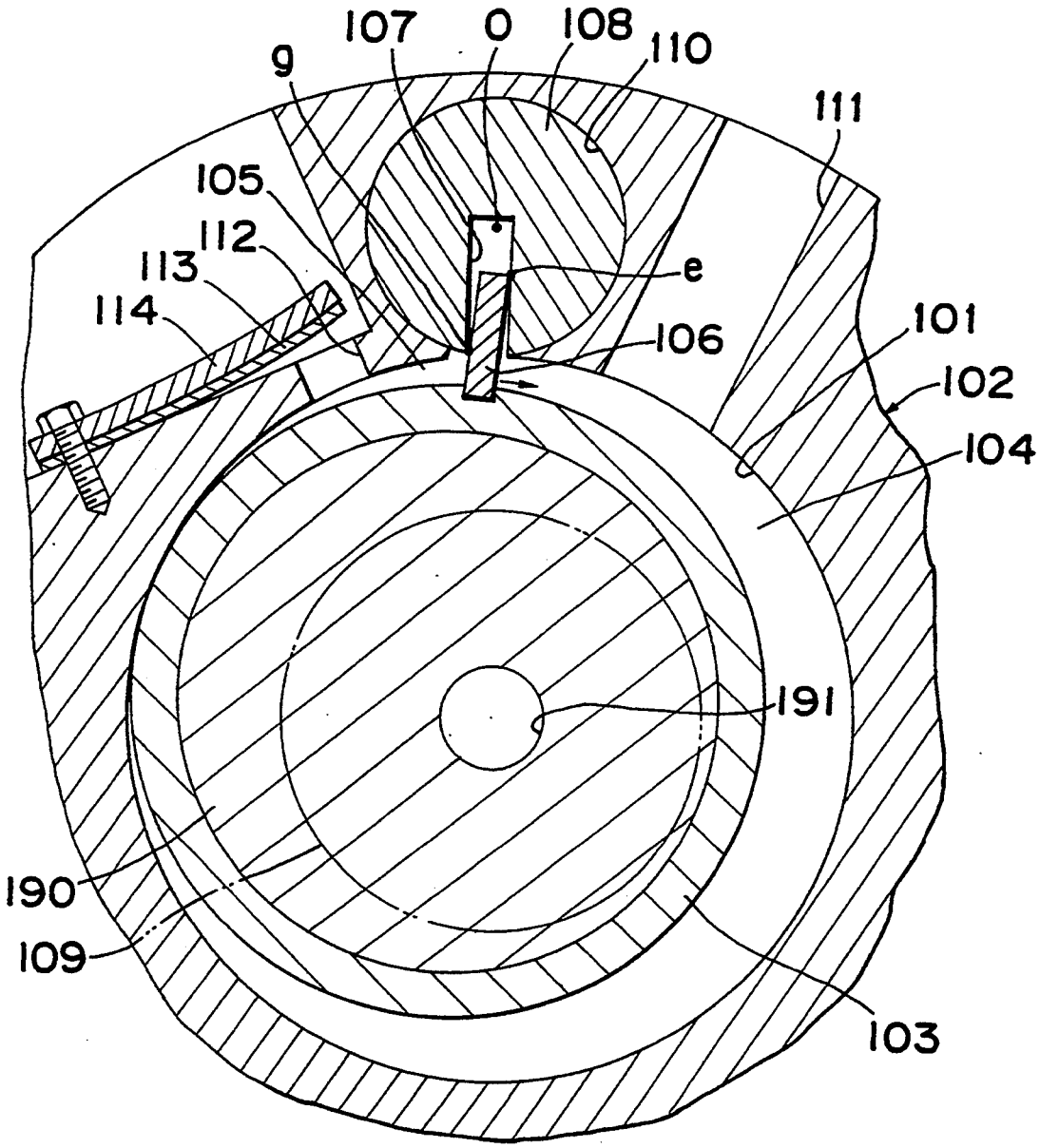
FIG. 17 is a sectional view at the time immediately before completion of the compression process according to the second embodiment of the present invention.

The rotary compressor as shown in FIGS. 16 and 17 is one for use in refrigerant compression. The rotary compressor comprises a cylinder 102 having a circular cylinder chamber 101, a roller 103 that orbits inside the cylinder chamber 101, a plate-like blade 106 protruded from and integral with the periphery of the roller 103 and partitioning the interior of the cylinder chamber 101 into a suction chamber 104 and a compression chamber 105, and a circular support member 108 that includes a receiving recess 107 for receiving the protruding tip of the blade 106 in such a way that the blade 106 can advance and retreat and that is rotatably held in the inside of a retaining hole 110 provided radially outwardly of the cylinder chamber 101, wherein the roller 103 revolves clockwise within the cylinder chamber 101 so that low-pressure gas taken in through a suction hole 111 is compressed and high-pressure gas is discharged inside the sealed casing via a discharge valve 113. In addition, designated by numeral 114 is a valve holder, and by 191 is an oil feed hole for conveying lubricating oil. The axial upper and lower portions of the cylinder chamber 101, although not shown, are sealed by front and rear heads.

With the above-described arrangement, the length of the blade 106 and the radius of the support member 108 are so set that after continuing revolving clockwise during the compression process, the roller 103 reaches the top dead point with the compression completed, that is, when the tip of the blade 106 is plunging into the receiving recess 107 most radially outward of the roller 103, the tip of the blade 106 will not go beyond the rotation center O of the support member 108.

By this arrangement, as shown in FIG. 16, when the roller 103 and the blade 106 are displaced in the direction indicated by the left-directed arrow, the blade 106 and the receiving recess 107 urge against each other via the blade right tip portion e and the recess left end portion g. Accordingly, naturally as it is, the edge contact at these end portions e and g allows the compression chamber 105 to be satisfactorily sealed with respect to the suction chamber 104. What is more, as shown in FIG. 17, even if the roller 103 and the blade 106 are displaced in the direction indicated by the right-directed arrow with progress of the compression process, the tip of the blade 106 will never go beyond the rotation center O of the support member 108. At this point, the blade 106 and the receiving recess 107 urge against each other via the blade right tip e and the recess left end portion g, keeping an edge contact via these end portions e and g. As a result, the compression chamber 105 can be satisfactorily sealed with respect to the suction chamber 104.

Consequently, high-pressure gas can be prevented from flowing from the compression chamber 105 into the bottom of the receiving recess 107 through a small clearance which might be formed between the left side face of the blade 106 and the receiving recess 107. Thus, gas leak that might occur via the receiving recess 107 toward the suction chamber 104 can be reduced and, besides, residual gas that is at the bottom of the receiving recess 107 at the end of the compression process can be prevented from re-expanding. Accordingly, in combination with the advantage that the blade 106 is fixed on the periphery of the roller 103 in the form of swinging type, the volume efficiency can be satisfactorily increased.

Figure 18:
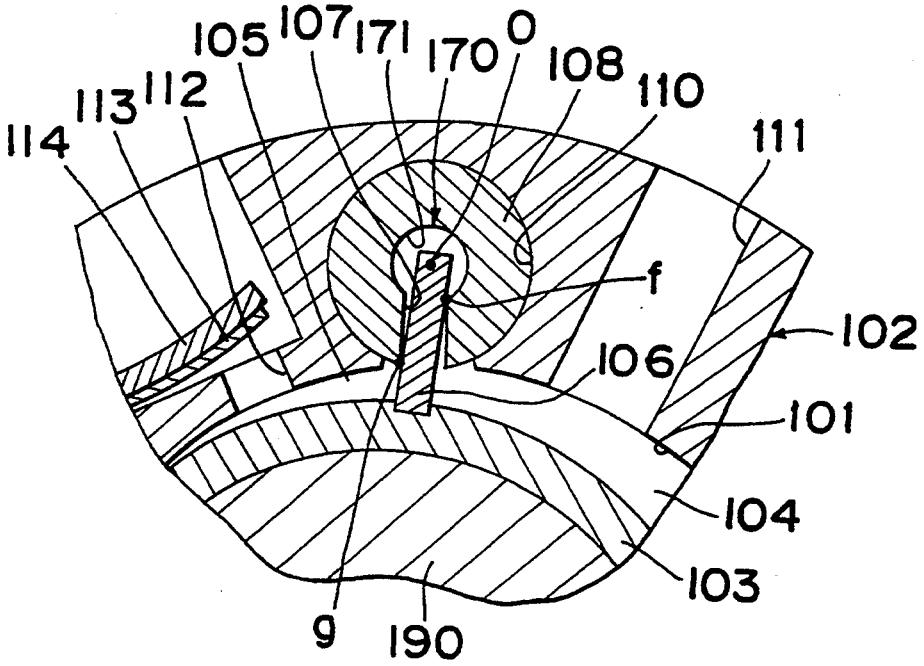
FIG. 18 is a partly sectional view showing the situation immediately before completion of the compression process in a modification of the second embodiment.
Figure 19:
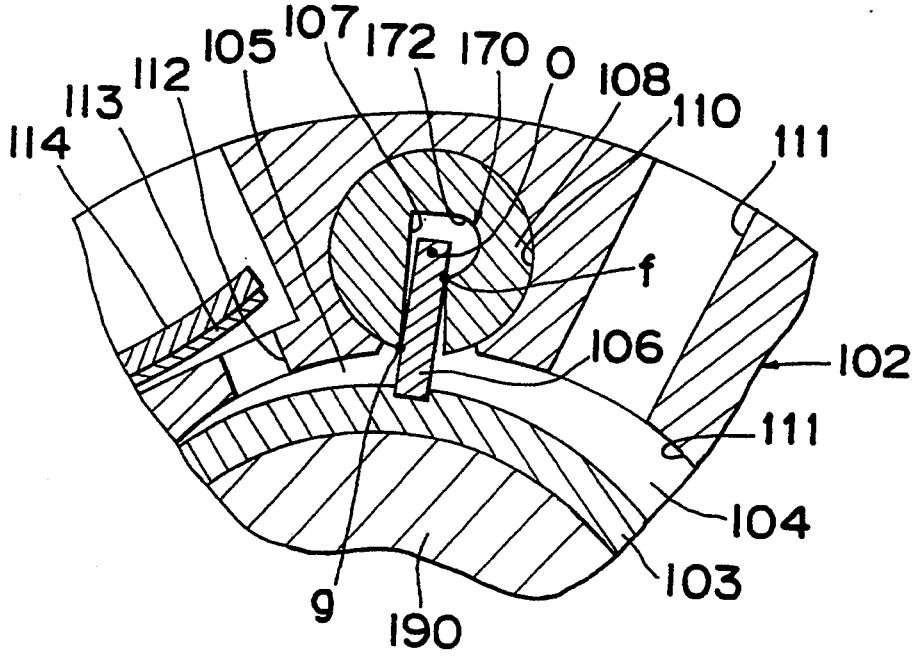
FIG. 19 is a partly sectional view showing the situation immediately before completion of the compression process in a modification of the second embodiment.

Further, as shown in FIG. 18, at the center of the support member 108, a cut hole 170 formed of a circular hole 171 or, as shown in FIG. 19, a cut hole 170 formed of a semicircular hole 172 may be provided so as to have such a largeness that a contact end portion f between the tip of the blade 106 and the receiving recess 107 is prohibited from going beyond the rotation center O of the support member 108 when the tip of the blade 106 has reached the deepest portion of the receiving recess 107.

In this case, as shown in FIG. 18 or 19, the contact end portion f between the tip of the blade 106 and the receiving recess 107 will never go beyond the rotation center O of the support member 108. The blade 106 and the receiving recess 107 urge against each other via the contact end portion f and the recess left end portion g. The edge contact via these end portions f and g is held so that the compression chamber 105 can be satisfactorily sealed with respect to the suction chamber 104. Also, in this case, since the cut hole 170 formed as the circular hole 171 or the semicircular hole 172 is used to prohibit the contact end portion f between the tip of the blade 106 and the receiving recess 107 from going beyond the rotation center O of the support member 108, the radius of the support member 108 can be made small and the arrangement around the support member 108 can be compacted, as compared with the embodiment shown in FIGS. 16 and 17.

As described above, according to this second embodiment, the length of the blade 106 and the radius of the support member 108 are set in such a relation that the tip of the blade 106 will not go beyond the rotation center O of the support member 108 when the tip of the blade 106 has plunged up to the deepest portion of the receiving recess 107. As a result, high-pressure gas can be prevented from flowing in from the compression chamber 105 to the bottom of the receiving recess 107, which might occur via a clearance opened between the blade 106 and the receiving recess 107. Thus, gas leak via the receiving recess 107 toward the suction chamber 104 can be reduced and besides residual gas that would stand at the bottom of the receiving recess 107 can be prevented from re-expanding. Therefore, in combination with the advantage that the blade 106 is fixed on the periphery of the roller 103 in the form of swinging type, the volume efficiency can be satisfactorily increased.

According to the above-described modified example, the volume efficiency can be satisfactorily increased. Besides, the contact end portion between the tip of the blade 106 and the receiving recess 107 will not go beyond the rotation center of the support member 108 by using the cut hole 170. Therefore, the arrangement around the support member 108 can be compacted.

(The third embodiment)

Figure 22:
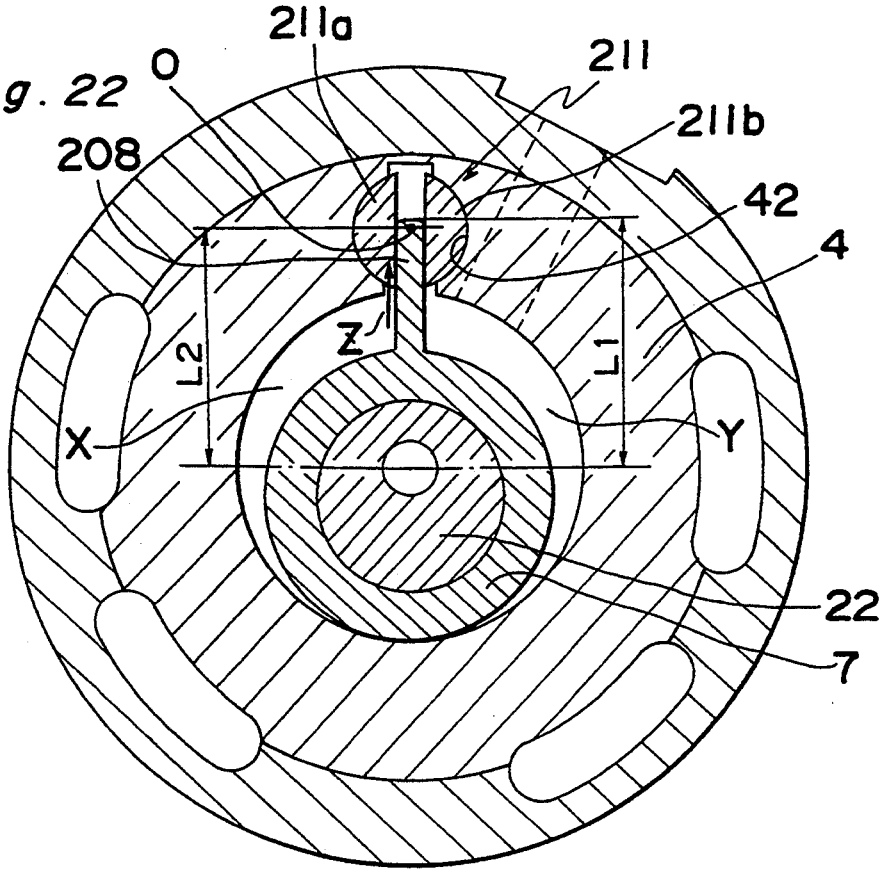
FIG. 22 is a sectional view showing the situation of the compression process of the compression section of the rotary compressor according to the third embodiment of the present invention.
Figure 23:
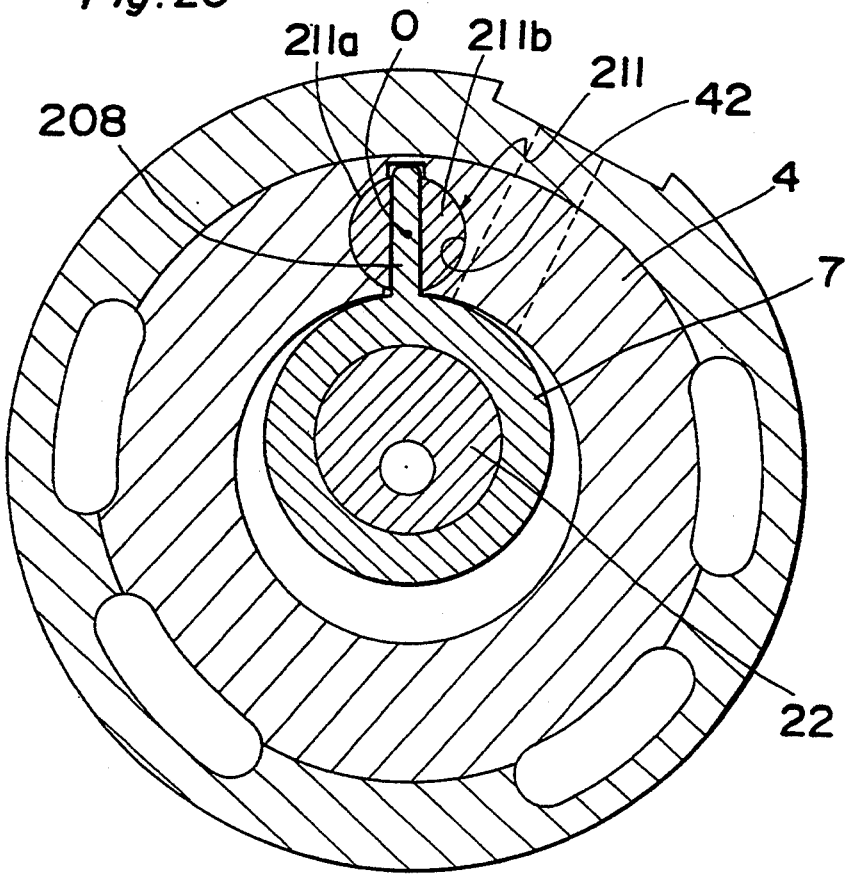
FIG. 23 is a sectional view showing the situation immediately before completion of the compression process of the compression section of the rotary compressor according to the third embodiment.
Figure 24:
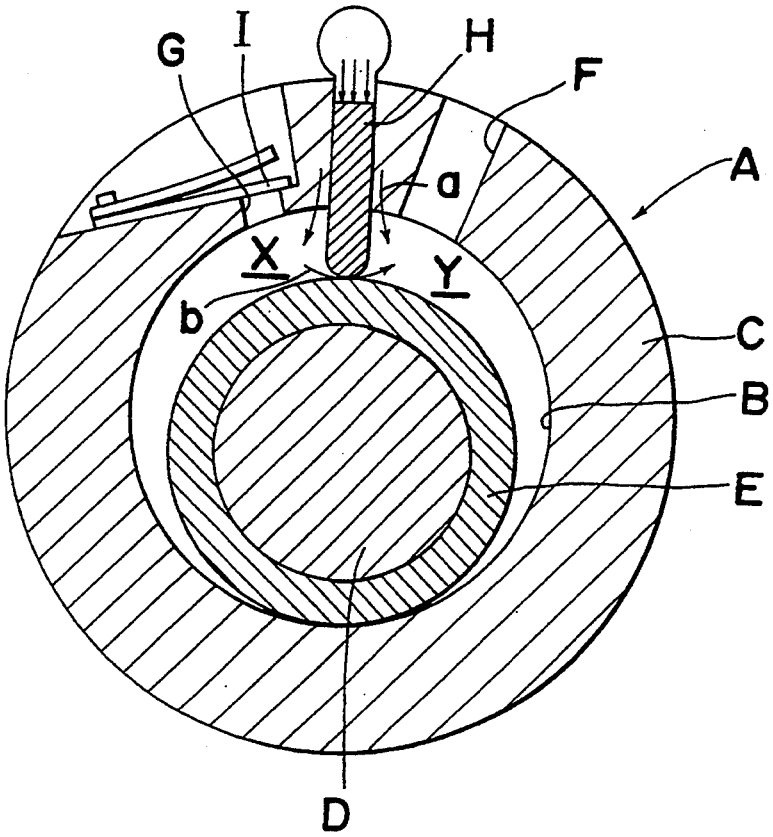
Fig. 24 PRIOR ART
FIG. 24 is a sectional view showing the compression section of a conventional rotary compressor.
Figure 25:
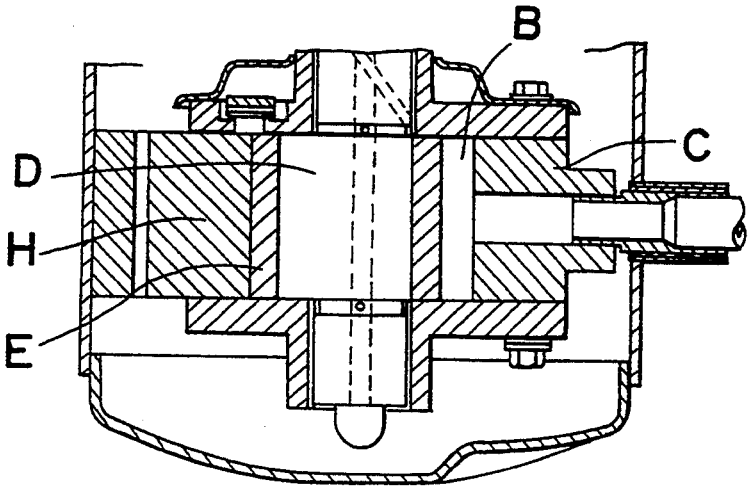
Fig. 25 PRIOR ART
FIG. 25 is a partly sectional view of the conventional rotary compressor.

FIGS. 22 and 23 are sectional views showing the third embodiment of the present invention. Referring to the figure, numeral 4 denotes a cylinder, 7 denotes a roller, and 22 denotes a driving shaft. The roller 7 has a blade 208 provided integrally therewith. The blade 208 is provided so as to be entered into and withdrawn from the receiving portion at the center of a cylindrical support member 211 swingably fitted in a cylindrical retaining hole 42 of the cylinder 4. The cylindrical support member 211 is made up of two semicircular members **211*a* and 211*b* completely separated from each other. The side face of the blade 208 is in sliding contact with the plane portions of the semicircular members 211*a* and 211*b*. The cylindrical surfaces of the semicircular members 211*a* and 211*b* are in sliding contact with the cylindrical surface of the retaining hole 42**.

As shown in FIG. 22, it is arranged that, when the roller 7 is farthest from the support member 211, length L1 between the center of a driving shaft 22 and the tip of the blade 208 is longer than length L2 between the center of the driving shaft 22 and the center O of the support member 211. As a result, even when the blade 208 protrudes radially most inwardly of the roller 7 from the receiving portion of the support member 211, part of the blade 208 still exists at the center O of the support member 211. It is noted that FIG. 23 illustrates a state in which the roller 7 is closest to the support member 211 with the compression process over.

With the above-described arrangement, the support member 211 is made up of two semicircular members **211*a* and 211*b*, of which one semicircular member 211*a* on the compression chamber X side is urged in the direction indicated by arrow Z by receiving a pressure from the side confronting the compression chamber X. As a result, the semicircular member 211*a* on the compression chamber X side is sandwiched by the cylindrical wall surface of the retaining hole 42 and the blade 208, like a wedge, thus increasing the sealing characteristic between the plane portion of the semicircular member 211*a* and the blade 208. Besides, the semicircular member 211*b* on the suction chamber Y side is also urged via the blade toward the wall surface of the retaining hole 42 accommodating the semicircular member 211*b*, by the wedge effect of the semicircular member 211*a* on the compression chamber X side, so that the sealing characteristic among the semicircular member 211*b* on the suction chamber Y side, the blade 208, and the cylindrical wall surface of the retaining hole 42 is also increased. Thus, the volume efficiency is increased. Furthermore, since the tip of the blade 208 is normally located radially outward of the roller 7 further than the rotation center O of the support member 211, the contact area between the blade 208 and the plane portions of the semicircular members 211***a* and 211*b* is increased, that is, the sealing length is increased, so that the sealing characteristic is increased. Accordingly, also by this arrangement, the volume efficiency is increased. In addition, since the support member 211 is made up of separately provided two semicircular members 211*a* and 211*b*, the work of assembling the blade 208 to the receiving portion at the center of the support member 211 is simplified.

This rotary compressor is intended primarily for use in refrigeration systems. The rotary compressor involves no friction between roller and blade and therefore is free of power loss, thus suited especially for refrigeration systems of which high efficiency as well as durability are required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotary compressor comprising:

a cylinder having a cylinder chamber;

a rotatable roller positioned in the cylinder chamber, the roller being rotatable in the cylinder chamber;

a blade partitioning the cylinder chamber into a compression chamber and a suction chamber, the suction chamber having a suction port and the compression chamber having a discharge port, gas being sucked through the suction port, compressed and discharged through the discharge port when the roller is rotated, the blade being integrated with the roller so that the blade protrudes radially outwardly from the roller;

an eccentric shaft portion of a driving shaft, the roller being mounted on the shaft and being eccentrically rotated therewith; and a support member being provided on the cylinder, the support member having a generally circular shape, the support member being rotatable and having a receiving portion for receiving a tip portion of the blade in such a manner that the tip portion of the blade is advanced and retreated from the support member;

wherein a thickness of the roller being thin at a high-temperature side portion on the compression chamber side and being thick at a low-temperature side portion on the suction chamber side.

2. The rotary compressor as claimed in claim 1, wherein the support member has a rotation center and is divided into two generally semicircular members, the blade being slidably disposed between the two generally semicircular members, the rotation center being between the tip portion of the blade and the roller.

3. The rotary compressor as claimed in claim 1, wherein the roller is provided with a fitting recess that receives a part of a base end of the blade, the part of the base end of the blade received in the fitting recess being brazed therewith so that the blade is integrated to the roller.

4. The rotary compressor as claimed in claim 1, further comprising a protrusion on a periphery of the roller, the protrusion extending toward the discharge port and being movable to plug the discharge port upon rotation of the roller.

5. The rotary compressor as claimed in claim 1, wherein the support member is rotatable about a rotation center, a hole being provided at a center of the support member, the hole being in communication with the receiving portion and being sized so that when the tip portion of the blade is deepest into the receiving portion, a contact end portion of the tip portion of the blade will contact the receiving portion and fail to extend beyond the rotation center of the support member.

6. A rotary compressor comprising:

a cylinder having a cylinder chamber;

a rotatable roller positioned in the cylinder chamber, the roller being rotatable in the cylinder chamber;

a blade partitioning the cylinder chamber into a compression chamber and a suction chamber, the suction chamber having a suction port and the compression chamber having a discharge port, gas being sucked through the suction port, compressed and discharged through the discharge port when the roller is rotated, the blade being integrated with the roller so that the blade protrudes radially outwardly from the roller;

an eccentric shaft portion of a driving shaft, the roller being mounted on the shaft and being eccentrically rotated therewith;

a support member being provided on the cylinder, the support member having a generally circular shape, the support member being rotatable and having a receiving portion for receiving a tip portion of the blade in such a manner that the tip portion of the blade is advanced and retreated from the support member;

a stepped recess provided on outer circumferential surface of the roller, the stepped recess having an axial center and axial ends, a deep recess portion being provided at the axial center and shallow recess portions being provided at both of the axial ends;

a fitting hole penetrating axially outwardly from both ends of the deep recess portion of the stepped recess;

a fitting portion having a fitting protrusion on the blade, the fitting protrusion being fitted into the deep recess portion of the stepped recess and a fitting hole being provided in the fitting protrusion, the fitting portion of the blade being fitted into the stepped recess; and a pin being insertable into the fitting holes in the stepped recess and the fitting protrusion to integrally couple the blade with the roller.

7. The rotary compressor as claimed in claim 6, wherein the support member has a rotation center and is divided into two generally semicircular members, the blade being slidably disposed between the two generally semicircular members, the rotation center being between the tip portion of the blade and the roller.

8. The rotary compressor as claimed in claim 6, wherein the roller is provided with a fitting recess that receives a part of a base end of the blade, the part of the base end of the blade received in the fitting recess being brazed therewith so that the blade is integrated to the roller.

9. The rotary compressor as claimed in claim 6, further comprising a protrusion on a periphery of the roller, the protrusion extending toward the discharge port and being movable to plug the discharge port upon rotation of the roller.

10. A rotary compressor comprising:

a cylinder having a cylinder chamber;

a rotatable roller positioned in the cylinder chamber, the roller being rotatable in the cylinder chamber, a convex portion provided on the periphery of the roller;

a blade partitioning the cylinder chamber into a compression chamber and a suction chamber, the suction chamber having a suction port and the compression chamber having a discharge port, gas being sucked through the suction port, compressed and discharged through the discharge port when the roller is rotated, the blade having a recess portion into with the convex portion of the roller is insertable;

a pin being insertable through the convex portion and the blade to integrally couple the blade to the roller, the blade protruding radially outwardly from the roller;

an eccentric shaft portion of a driving shaft, the roller being mounted on the shaft and being eccentrically rotated therewith; and a support member being provided on the cylinder, the support member having a generally circular shape, the support member being rotatable and having a receiving portion for receiving a tip portion of the blade in such a manner that the tip portion of the blade is advanced and retreated from the support member.

11. The rotary compressor as claimed in claim 10, wherein the support member has a rotation center and is divided into two generally semicircular members, the blade being slidably disposed between the two generally semicircular members, the rotation center being between the tip portion of the blade and the roller.

12. The rotary compressor as claimed in claim 10, wherein the roller is provided with a fitting recess that receives a part of a base end of the blade, the part of the base end of the blade received in the fitting recess being brazed therewith so that the blade is integrated to the roller.

13. The rotary compressor as claimed in claim 10, further comprising a protrusion on a periphery of the roller, the protrusion extending toward the discharge port and being movable to plug the discharge port upon rotation of the roller.

14. A rotary compressor comprising:

a cylinder having a cylinder chamber;

a rotatable roller positioned in the cylinder chamber, the roller being rotatable in the cylinder chamber;

a blade partitioning the cylinder chamber into a compression chamber and a suction chamber, the suction chamber having a suction port and the compression chamber having a discharge port, gas being sucked through the suction port, compressed and discharged through the discharge port when the roller is rotated, the blade being integrated with the roller so that the blade protrudes radially outwardly from the roller and the blade having a predetermined length;

an eccentric shaft portion of a driving shaft, the roller being mounted on the shaft and being eccentrically rotated therewith; and a support member being provided on the cylinder, the support member having a generally circular shape and a radius, the support member being rotatable about a rotation center and having a receiving portion for receiving a tip portion of the blade in such a manner that the tip portion of the blade is advanced and retreated from the support member, wherein the predetermined length of the blade and the radius of the support member are set so that when the tip portion of the blade is most deeply fitted into the receiving portion, the tip portion of the blade fails to extend beyond the rotation center of the support member.

15. The rotary compressor as claimed in claim 14, wherein the support member is divided into two generally semicircular members, the blade being slidably disposed between the two generally semicircular members, the rotation center of the support member being between the tip portion of the blade and the roller.

16. The rotary compressor as claimed in claim 14, wherein the roller is provided with a fitting recess that receives a part of a base end of the blade, the part of the base end of the blade received in the fitting recess being brazed therewith so that the blade is integrated to the roller.

17. The rotary compressor as claimed in claim 14, further comprising a protrusion on a periphery of the roller, the protrusion extending toward the discharge port and being movable to plug the discharge port upon rotation of the roller.

18. A rotary compressor comprising:

a cylinder having a cylinder chamber;

a rotatable roller positioned in the cylinder chamber, the roller being rotatable in the cylinder chamber;

a blade partitioning the cylinder chamber into a compression chamber and a suction chamber, the suction chamber having a suction port and the compression chamber having a discharge port, gas being sucked through the suction port, compressed and discharged through the discharge port when the roller is rotated, the blade being integrated with the roller so that the blade protrudes radially outwardly from the roller;

an eccentric shaft portion of a driving shaft, the roller being mounted on the shaft and being eccentrically rotated therewith; and a support member being provided on the cylinder, the support member having a generally circular shape, the support member being rotatable about a rotation center and having a receiving portion for receiving a tip portion of the blade in such a manner that the tip portion of the blade is advanced and retreated from the support member, a hole being provided at a center of the support member, the hole being in communication with the receiving portion and being sized so that when the tip portion of the blade is deepest into the receiving portion, a contact end portion of the tip portion of the blade will contact the receiving portion and fail to extend beyond the rotation center of the support member.

19. The rotary compressor as claimed in claim 18, wherein the support member is divided into two generally semicircular members, the blade being slidably disposed between the two generally semicircular members, the rotation center of the support member being between the tip portion of the blade and the roller.

20. The rotary compressor as claimed in claim 18, wherein the roller is provided with a fitting recess that receives a part of a base end of the blade, the part of the base end of the blade received in the fitting recess being brazed therewith so that the blade is integrated to the roller.

21. The rotary compressor as claimed in claim 18, further comprising a protrusion on a periphery of the roller, the protrusion extending toward the discharge port and being movable to plug the discharge port upon rotation of the roller.

22. The rotary compressor as claimed in claim 18, wherein the hole in the support member has a generally circular shape.

23. The rotary compressor as claimed in claim 18, wherein the hole in the support member has a generally semicircular shape.

* * * * *